US006604841B2

(12) United States Patent
Liu

(10) Patent No.: US 6,604,841 B2
(45) Date of Patent: Aug. 12, 2003

(54) ROPE LIGHT WITH A #-SHAPED CORE

(76) Inventor: Wei-Jen Liu, 3F-1, No. 193-2, Nanya St., Hsinchu (TW)

( * ) Notice: Subject to any disclaimer, the term of this patent is extended or adjusted under 35 U.S.C. 154(b) by 0 days.

(21) Appl. No.: 09/973,876

(22) Filed: Oct. 11, 2001

(65) Prior Publication Data

US 2003/0072155 A1 Apr. 17, 2003

(51) Int. Cl.[7] ..... F21S 13/14

(52) U.S. Cl. ..... 362/252; 362/227; 362/240; 362/249

(58) Field of Search ..... 362/227, 249, 362/252, 240

(56) References Cited

U.S. PATENT DOCUMENTS 4,263,640 A * 4/1981 Altman ..... 362/252
4,271,458 A * 6/1981 George, Jr. ..... 362/252
6,039,458 A * 3/2000 Coates et al. ..... 362/252
6,352,355 B1 * 3/2002 Law ..... 362/253
6,394,623 B1 * 5/2002 Tsui ..... 362/252
6,406,166 B1 * 6/2002 Ko ..... 362/252

* cited by examiner

*Primary Examiner*—Sandra O'Shea
*Assistant Examiner*—Ismael Negron
(74) *Attorney, Agent, or Firm*—Birch, Stewart, Kolasch & Birch, LLP

(57) ABSTRACT

A rope light mainly includes a #-sectioned elongate core enclosed in an outer tube, and a plurality of bulb strings parallelly set in two adjacent channels defined on the elongate core. The elongate core includes two or three spaced conductors pre-embedded therein when the core is formed, and the two selected channels are provided at bottom surfaces with a plurality of radially extended and staggered implant holes for receiving alternate bulbs and holding terminals connecting adjacent bulbs in the bulb string. The #-sectioned core has structural strength and the radially positioned bulbs and holding terminals provide supporting forces to protect the rope light from damaged bulbs or short circuit. The holding terminals may be reflective members or covered with reflective sleeves to reflect light beams emitted by the bulbs and thereby increase the illuminance of the rope light.

6 Claims, 6 Drawing Sheets

ROPE LIGHT WITH A #-SHAPED CORE

BACKGROUND OF THE INVENTION

The present invention relates to a rope light, and more particularly to a rope light having a #-sectioned long core and a plurality of staggered bulbs radially inserted into the core to form a plurality of parallelly extended bulb strings on the core, enabling the rope light to have intensified illuminance.

FIGS. 1 and 2 show two types of conventional rope lights. The first type of the conventional rope light includes a plurality of bulbs 10 that are serially connected to one another by sequentially connecting lead wires 101 of two adjacent bulbs 10 together to form a bulb string, which is then set in a long core tube 20 to extend in parallel with the core tube 20. Lead wires 101 of a first and a last bulb 10 in the bulb string are respectively connected to a positive and a negative conductor 201, 202 pre-embedded in the core tube 20 to form a close circuit on the rope light, as shown in FIG. 1.

The second type of the conventional rope light includes a long core tube 20*a* having one positive conductor 201 and two negative conductors 202 pre-embedded therein, and two bulb strings formed from a plurality of groups of serially connected bulbs 10 parallelly set in the core tube 20 at the same time. Lead wires 101 of a first and a last bulb 10 in each of the two bulb strings are respectively connected to the positive conductor 201 and one of the two negative conductors 202, so that two close circuits are formed for the rope light, as shown in FIGS. 2 and 3. It is to be noted the bulb groups 10 on the two bulb strings are staggered in the core tube 20*a*, as shown in FIG. 2, and lead wires 101 connected between two adjacent bulb groups 10 in the same one bulb string are covered with insulated sleeves 102, so as to ensure that lead wires 101 on the two bulb strings would not contact with one another to cause a short circuit.

To set the bulbs 10 into the core tube 20, 20*a* of the above-described conventional rope light, the core tube 20, 20*a* is provided at one side with a longitudinal opening via which the bulb string or strings are put into the core tube 20, 20*a*. The longitudinal opening largely reduces an overall structural strength of the core tube 20, 20*a*, particularly that at two sides of the longitudinal opening. When the rope light is used on a stage or at places close to steps and tends to be twisted, deformed, trodden or impacted, the core tube 20, 20*a* with reduced structural strength is not strong enough to bear such external forces, resulting in damaged bulbs 10 in the core tube 20, 20*a*. Moreover, it is difficult and requires increased material and labor costs to mount the insulated sleeves 102 around the staggered lead wires 101 between two adjacent bulb groups on the two bulb strings that are set in the core tube 20, 20*a* at the same time. The conventional rope light with two bulb strings is therefore not economical for use.

Moreover, the lead wires 101 on the adjacent bulbs 10 are connected by way of welding or twisted together with hand tools to form the bulb string, which involves complicated procedures.

It is therefore tried by the inventor to develop an improved rope light to eliminate the drawbacks existing in the conventional rope lights.

SUMMARY OF THE INVENTION

A primary object of the present invention is to provide a rope light having a #-sectioned long core, so that separated channels are defined on the core for locating at least two parallelly extended bulb strings formed from a plurality of serially connected bulbs. The bulb strings so arranged in the long core ensure non-contact of lead wires on bulbs of the two bulb strings, and the #-sectioned structure of the long core provides the best support for the bulbs.

Another object of the present invention is to provide a rope light, in which lead wires on two adjacent bulbs of the same bulb string for the rope light are connected with a reflective holding terminal, and the bulbs and the holding terminals are alternately inserted into implant holes radially extended on the core of the rope light. Thereby, the holding terminals reflect light beams emitted by the bulbs to intensify the illuminance of the rope light, and the assembling of the bulbs into bulb strings is effectively simplified.

BRIEF DESCRIPTION OF THE DRAWINGS

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

The structure and the technical means adopted by the present invention to achieve the above and other objects can be best understood by referring to the following detailed description of the preferred embodiments and the accompanying drawings which are given by way of illustration only, and thus are not limitative of the present invention, wherein.

DETAILED DESCRIPTION OF THE PREFERRED EMBODIMENTS

Figure 4:
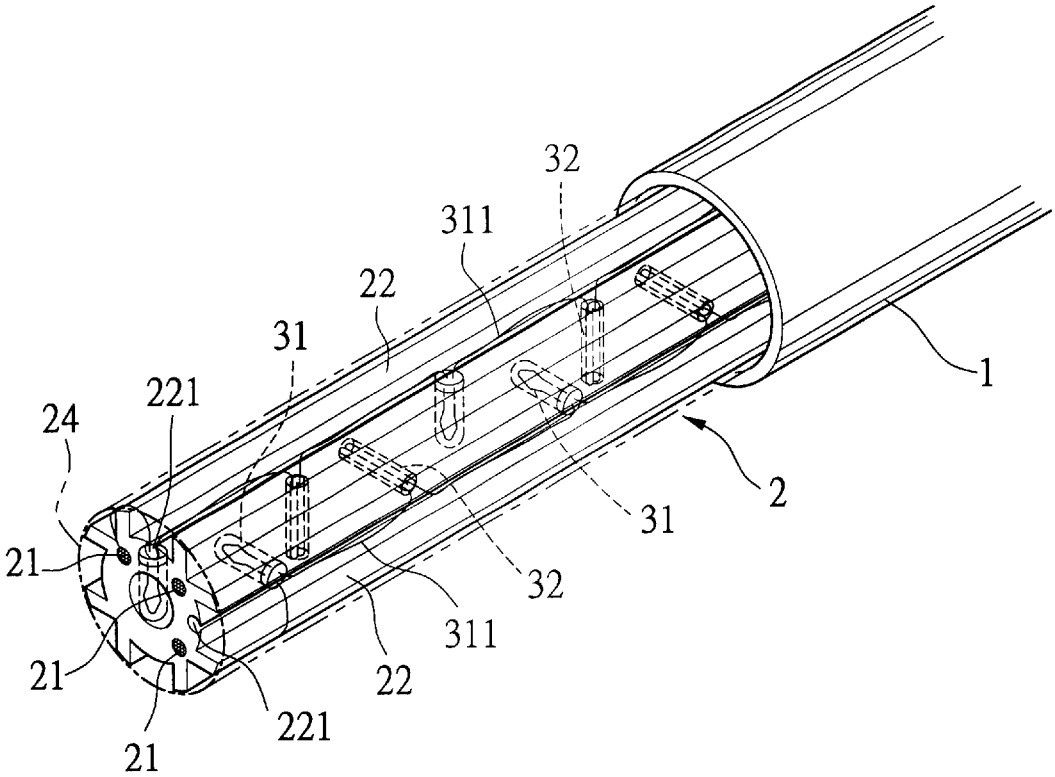
FIG. 4 is an assembled perspective view of a rope light according to the present invention.
Figure 5:
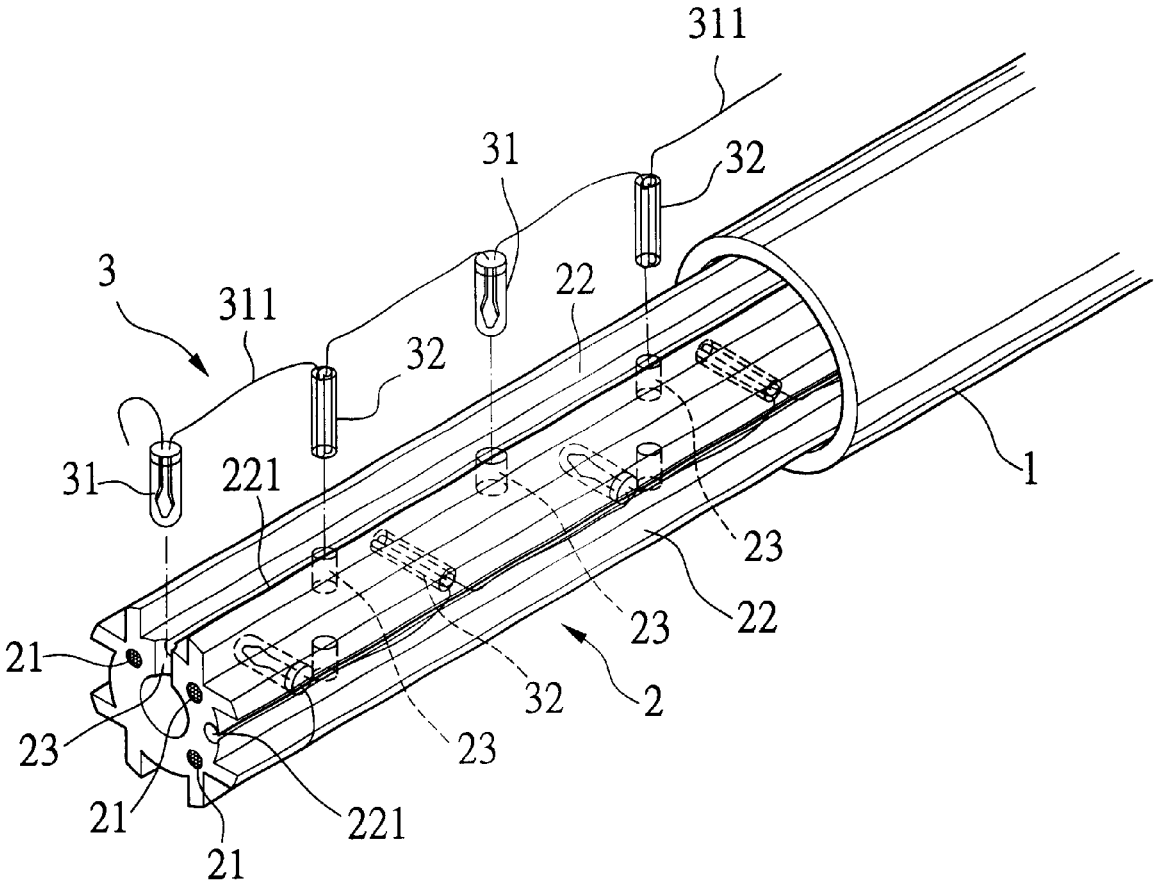
FIG. 5 is a partially exploded perspective view of the rope light of FIG. 4.

Please refer to FIGS. 4 and 5 that are assembled and partially exploded perspective views, respectively, of a rope light according to the present invention. As shown, the rope light mainly includes an outer tube 1, an elongate core 2, and two bulb strings 3. Bulbs 31 on the bulb strings 3 are sequentially implanted on the elongate core 2. After all the bulbs 31 have been implanted, the elongate core 2 with the bulb strings 3 is put into and enclosed in the outer tube 1 that is made of a transparent PVC material. Since the outer tube 1 is a conventional member, it is not discussed in details herein.

The elongate core 2 is made of a transparent PVC material and has a cross section similar to the symbol "#". Two or three conductors 21 are pre-embedded in the #-sectioned core 2 at spaced positions when the core 2 is formed through drawing. The #-sectioned core 2 defines four circumferentially spaced channels 22 to axially extend a full length of the core 2. Two adjacent ones of the four channels 22 are selected and provided at bottom surfaces with an axially extended groove 221 each, and a plurality of radially extended implant holes 23 are staggered in the two selected channels 22, such that each of the two grooves 221 extends through outer ends of every implant holes 23 provided in the same channel 22.

Each of the two bulb strings 3 includes a plurality of bulbs 31 or light-emitting diodes (LED) as a light source thereof. Each of the bulbs 31 has two lead wires 311 extended from a bottom thereof. Any two adjacent bulbs 31 in the same bulb string 3 are serially connected with a reflective holding terminal 32 that connects one lead wire 311 of a precedent bulb 31 and one lead wire 311 of a following bulb 31 together.

Figure 6:
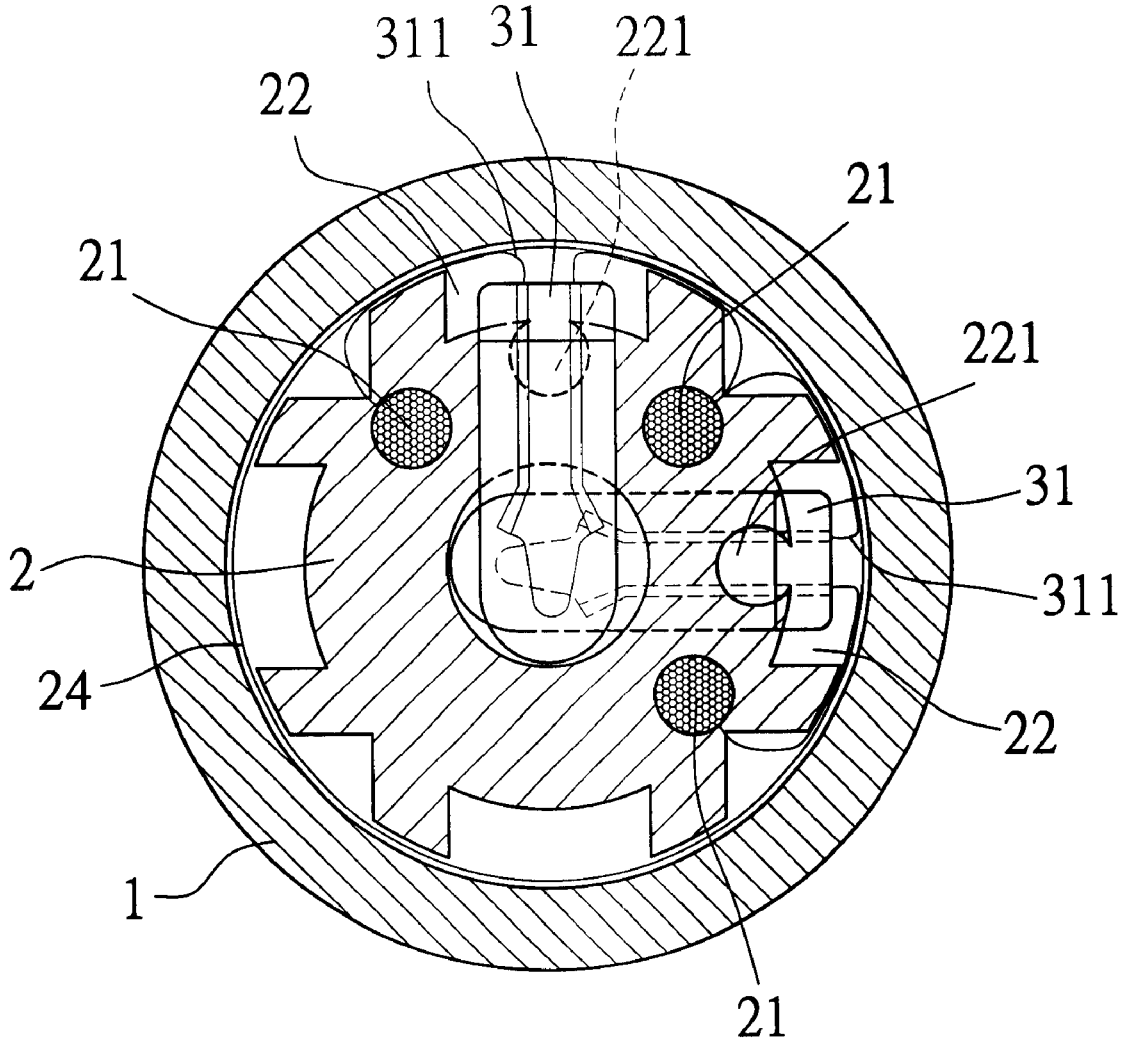
FIG. 6 is a cross sectional view of FIG. 4.
Figure 7:
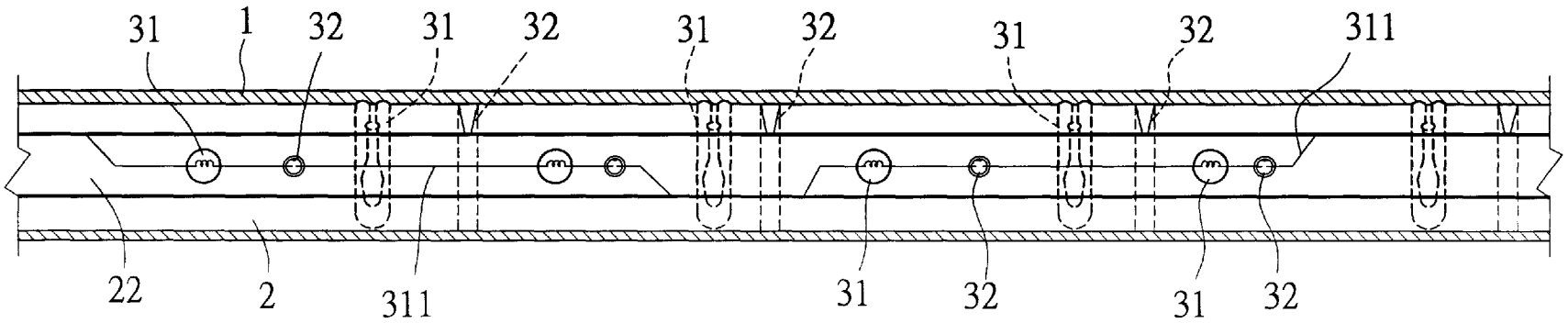
FIG. 7 shows the arrangement of bulb strings in the rope light of the present invention.

The bulb strings 3 are separately laid in the selected channels 22 on the elongate core 2, such that the bulbs 31 and the holding terminals 32 of each bulb string 3 are alternately inserted into the implant holes 23 one by one, as shown in FIG. 5. Portions of the lead wires 311 of each bulb string 3 that extend between adjacent bulbs 31 and holding terminals 32 are forced into the groove 221 of the channel 22 in which the bulb string 3 is laid, so that they are concealed in the groove 221, as shown in FIG. 4. Please refer to FIG. 6. The bulbs 31 and the holding terminals 32 of the bulb strings 3 in the radially extended implant holes 23 are in a position normal to the elongate core 2. Lead wires 311 of a first and a last bulb 31 in each bulb string 3 that are not connected to any other lead wire 311 of intermediate bulbs 31 are electrically connected to one positive and one negative conductor 21, respectively, to form a circuit, as shown in FIG. 7. Finally, the core 2 with the bulb strings 3 fixed thereto is enclosed in the outer tube 1 to form a rope light having parallel bulb strings 3 of serially connected bulbs 31 to give high illuminance.

Alternatively, the core 2 with the bulb strings 3 fixed thereto may be coated with a thin layer of film 24 that may be transparent tape, clear PVC film or other suitable materials, before being enclosed in the outer tube 1. Patterns, designs or words may be printed on a surface of the thin layer of film 24 to increase a visual beauty of the rope light or to achieve an advertising or warning purpose.

Figure 1:
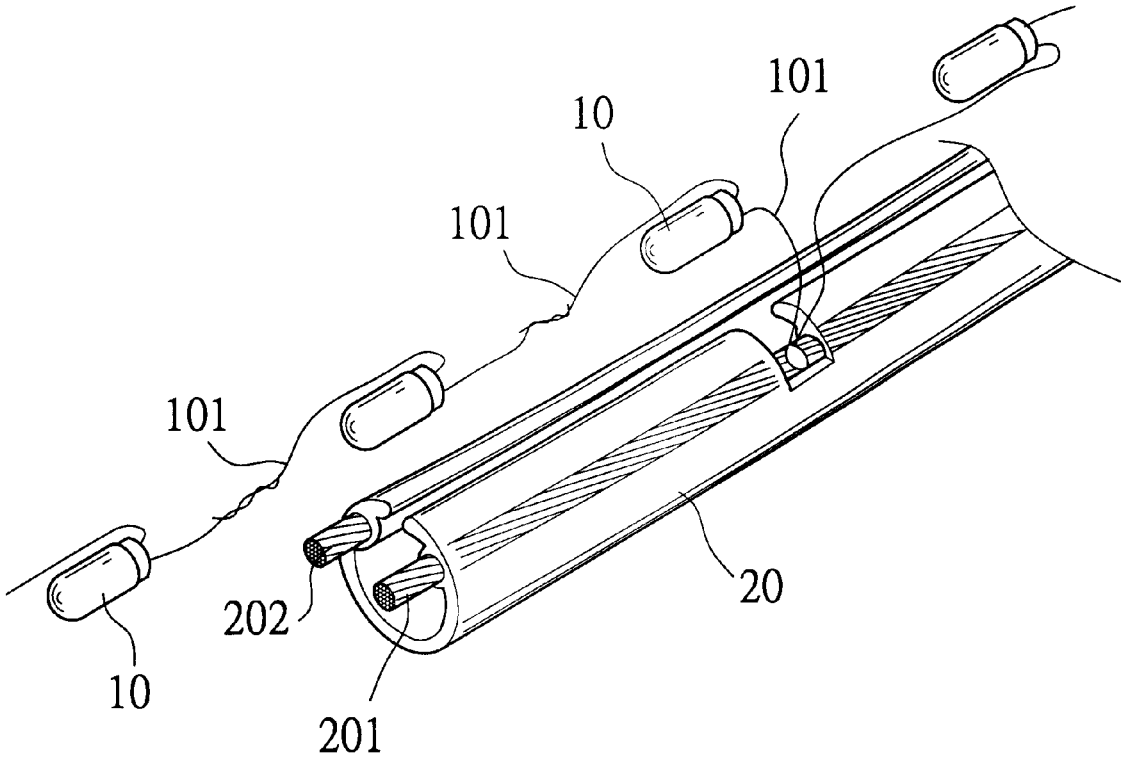
(PRIOR ART) Fig.1
FIG. 1 is an exploded perspective view of a conventional rope light having one single bulb string formed from serially connected bulbs.
Figure 2:
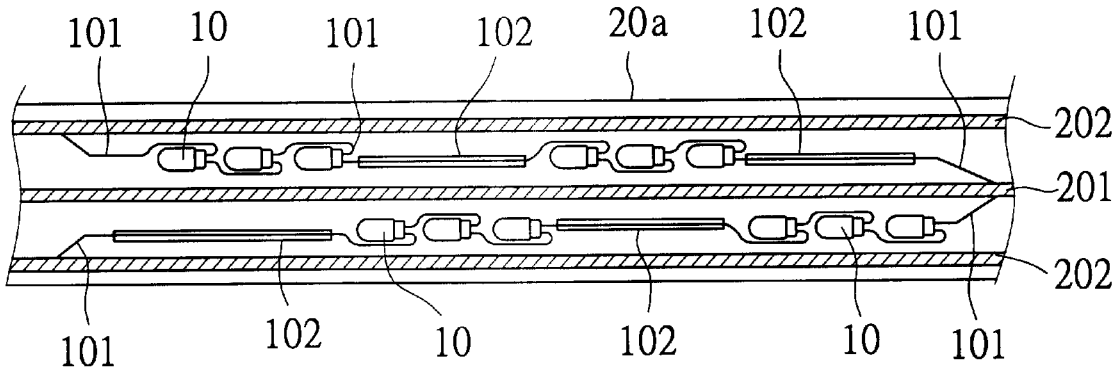
(PRIOR ART) Fig.2
FIG. 2 is an assembled bottom sectional view of a conventional rope light having two parallel bulb strings formed from serially connected bulbs.
Figure 3:
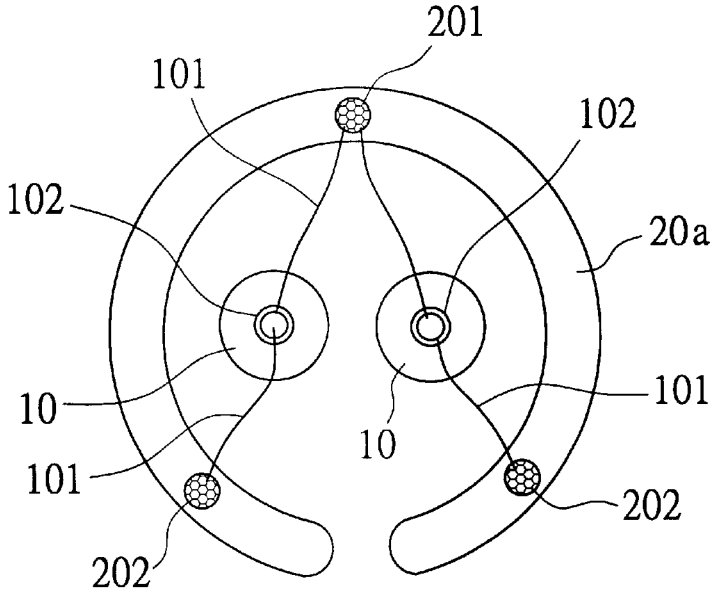
(PRIOR ART) Fig.3
FIG. 3 is a cross sectional view of FIG. 2.

The #-sectioned structure of the core 2 provides considerably high structural strength, as compared with the conventional core tube 20 of FIG. 1. Moreover, the bulbs 31 and the holding terminals 32 on one of the two bulb strings 3 are normal to those on the other bulb string 3, providing two mutually supporting forces. When the rope light is subject to an impact from any direction at any angle, bulbs 31 in the impacted channel 22 are not easily damaged under protection provided by the #-sectioned core 2 and a supporting force from the bulbs 31 and holding terminals 32 in the adjacent bulb string 3. The rope light could therefore have an extended usable life.

The bulbs 31 and the reflective holding terminals 32 are alternately arranged in each bulb string 3 and inserted in the implant holes 23 on the elongate core 2. The holding terminals 32 reflect a part of light beams emitted from the bulbs 31 to form another light source, allowing the rope light to have intensified illuminance. Moreover, the holding terminals 32 enable much more simplified and rapid connection of lead wires 311 between two adjacent bulbs 31, as compared with the conventional rope light in which the lead wires between two adjacent bulbs are welded or twisted together.

In another embodiment of the present invention, the holding terminals 32 themselves are not reflective.

However, a reflective sleeve is put over an outer surface of each holding terminal 32 to obtain the same reflecting effect between any two adjacent bulbs 31.

The present invention has been described with some preferred embodiments thereof and it is understood that many changes and modifications in the described embodiments can be carried out without departing from the scope and the spirit of the invention that is intended to be limited only by the appended claims.

What is claimed is:

1. A rope light, comprising an outer tube, an elongate core enclosed in said outer tube, and a plurality of bulb strings set in said elongate core to be enclosed in said outer tube along with said elongate core;

said elongate core having a #-shaped cross section, and including two or three conductors pre-embedded therein at spaced positions when said core is formed through drawing; said #-sectioned core defining four circumferentially separated channels to axially extend a full length of said core, two adjacent ones of said four channels being selected and provided at bottom surfaces with a plurality of radially extended implant holes that are staggered on said two selected channels; and each of said plurality of bulb strings including a plurality of bulbs or light-emitting diodes as a light source thereof, each of said bulbs having two lead wires extended from a bottom thereof, any two adjacent bulbs in the same one of said bulb strings being serially connected with a holding terminal that connects one of said two lead wires of a precedent bulb to one of said two lead wires of a following bulb; and said plurality of bulb strings being separately laid in said selected channels on said elongate core, such that said bulbs and said holding terminals of each said bulb string are alternately inserted into said implant holes one by one to be radially normal to said core; said lead wires of a first and a last one of said bulbs in each of said bulb strings that are not connected to any of said lead wires of intermediate ones of said bulbs being electrically connected to a positive and a negative one, respectively, of said pre-embedded conductors to form a circuit; and said core with said plurality of bulb strings parallelly fixed thereto being finally enclosed in said outer tube to complete said rope light that has a high illuminance.

2. The rope light as claimed in claim 1, wherein said holding terminals are capable of reflecting light beams.

3. The rope light as claimed in claim 1, wherein each of said holding terminals has a reflective sleeve put on an outer side thereof.

4. The rope light as claimed in claim 1, wherein each of said selected channels on said #-sectioned elongate core is provided at said bottom surface with a groove axially extended through outer ends of every one of said implant holes.

5. The rope light as claimed in claim 1, wherein said elongate core with said plurality of bulb strings fixed thereto is coated with a thin layer of film before being enclosed in said outer tube, so as to allow printing of patterns, designs or words on an outer surface of said film.

6. The rope light as claimed in claim 5, wherein said thin layer of film is formed from transparent tape or clear PVC material.

* * * * *